US012565827B2

(12) United States Patent
Zhong et al.

(10) Patent No.: US 12,565,827 B2
(45) **Date of Patent: *Mar. 3, 2026**

(54) ELECTRICALLY DRIVEN FRACTURING SYSTEM

(71) Applicant: YANTAI JEREH PETROLEUM EQUIPMENT & TECHNOLOGIES CO., LTD., Shandong (CN)

(72) Inventors: Jifeng Zhong, Shandong (CN); Shuzhen Cui, Shandong (CN); Shouzhe Li, Shandong (CN); Liang Lv, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/905,719

(22) Filed: Oct. 3, 2024

(65) Prior Publication Data

US 2025/0027398 A1 Jan. 23, 2025

Related U.S. Application Data

(63) Continuation of application No. 18/340,243, filed on Jun. 23, 2023, now Pat. No. 12,134,964, which is a (Continued)

(30) Foreign Application Priority Data

Sep. 22, 2021 (CN) ..... 202122291390.0

(51) Int. Cl.
*E21B 43/26* (2006.01)
*E21B 43/12* (2006.01)

(52) U.S. Cl.
CPC ..... *E21B 43/2607* (2020.05); *E21B 43/12* (2013.01); *E21B 43/26* (2013.01)

(58) Field of Classification Search
CPC ..... E21B 43/2607; E21B 43/12; E21B 43/26
See application file for complete search history.

(56) References Cited

U.S. PATENT DOCUMENTS 10,801,311 B1 10/2020 Cui et al.
10,865,624 B1 12/2020 Cui et al.
(Continued)

FOREIGN PATENT DOCUMENTS

AU 2013206463 A1 1/2015
CN 102602322 A 7/2012
(Continued)

OTHER PUBLICATIONS

Notice of Allowance for U.S. Appl. No. 16/834,433 mailed on Jun. 12, 2020.
(Continued)

*Primary Examiner* — James G Sayre
(74) *Attorney, Agent, or Firm* — Sheppard Mullin Richter & Hampton LLP

(57) ABSTRACT

An electrically driven fracturing system is provided. The electrically driven fracturing system includes: one or more frequency converter apparatuses; and a plurality of electrically driven fracturing apparatuses configured to pressurize and output fluid. One of the one or more frequency converter apparatuses is connected with multiple ones of the plurality of electrically driven fracturing apparatuses, respectively, and the frequency converter apparatus is configured to adjust pressure and flow rate of fluid output by the multiple electrically driven fracturing apparatuses.

20 Claims, 3 Drawing Sheets

Related U.S. Application Data continuation of application No. 17/508,913, filed on Oct. 22, 2021, now Pat. No. 11,725,491.

(56) References Cited

U.S. PATENT DOCUMENTS

| | | | |
|---|---|---|---|
| 11,181,107 | B2 | 11/2021 | Oehring et al. |
| 11,725,491 | B2 | 8/2023 | Zhong et al. |
| 12,134,964 | B2 * | 11/2024 | Zhong ..... E21B 43/26 |
| 2003/0200761 | A1 | 10/2003 | Funahashi et al. |
| 2007/0176394 | A1 | 8/2007 | Gehring et al. |
| 2015/0114652 | A1 | 4/2015 | Lestz et al. |
| 2015/0300336 | A1 | 10/2015 | Hernandez et al. |
| 2017/0037718 | A1 | 2/2017 | Coli et al. |
| 2017/0302135 | A1 | 10/2017 | Cory |
| 2018/0156210 | A1 | 6/2018 | Oehring et al. |
| 2019/0169971 | A1 | 6/2019 | Oehring et al. |
| 2019/0245348 | A1 | 8/2019 | Hinderliter et al. |
| 2020/0109616 | A1 | 4/2020 | Oehring et al. |
| 2020/0109617 | A1 | 4/2020 | Oehring et al. |
| 2021/0095552 | A1 | 4/2021 | Oehring et al. |

FOREIGN PATENT DOCUMENTS

| | | | |
|---|---|---|---|
| CN | 203261243 | U | 10/2013 |
| CN | 204316091 | U | 5/2015 |
| CN | 204361910 | U | 5/2015 |
| CN | 204928048 | U | 12/2015 |
| CN | 207194878 | U | 4/2018 |
| CN | 108900136 | A | 11/2018 |
| CN | 208548823 | U | 2/2019 |
| CN | 110155193 | A | 8/2019 |
| CN | 209687698 | U | 11/2019 |
| CN | 110784127 | A | 2/2020 |
| CN | 210049880 | U | 2/2020 |
| CN | 110913661 | A | 3/2020 |
| CN | 210139911 | U | 3/2020 |
| CN | 111917042 | A | 11/2020 |
| CN | 211930537 | U | 11/2020 |
| CN | 211958423 | U | 11/2020 |
| CN | 112423562 | A | 2/2021 |
| CN | 212671744 | A | 3/2021 |
| CN | 113404478 | A | 9/2021 |
| CN | 114204468 | A | 3/2022 |
| DE | 10347561 | B3 | 1/2005 |

OTHER PUBLICATIONS

Written Opinion of the International Searching Authority and International Search Report for PCT Application No. PCT/ CN2019/102809 mailed on Mar. 11, 2020.

International Preliminary Report on Patentability Chapter I for PCT Application No. PCT/CN2019/102809 mailed on Dec. 23, 2021.

International Search Report for PCT Application No. PCT/CN2021/125211 mailed on Jun. 22, 2022.

Song et al., "Design of medium-voltage combined frequency converter for petroleum-driven fracturing."

Non-Final Office Action for U.S. Appl. No. 17/508,913 mailed on Aug. 16, 2022.

First Search for Chinese Application No. 201910510839.2 mailed on Sep. 7, 2023.

Non-Final Office Action for U.S. Appl. No. 18/340,243 mailed on Apr. 9, 2024.

Notice of Allowance for U.S. Appl. No. 18/340,243 mailed on Jul. 10, 2024.

International Preliminary Report on Patentability Chapter I for PCT Application No. PCT/CN2021/125211 mailed on Apr. 4, 2024.

First Office Action for Chinese Application No. 202210990866.6 mailed on Apr. 8, 2025.

Non-Final Office Action for U.S. Appl. No. 18/317,246 mailed on Oct. 3, 2025.

Rejection Decision for Chinese Application No. 202210990866.6 mailed on Aug. 16, 2025 with English summary.

Notice of Allowance for Canadian Application No. 3173687 mailed on Aug. 27, 2025.

* cited by examiner

ELECTRICALLY DRIVEN FRACTURING SYSTEM

CROSS-REFERENCE TO RELATED APPLICATIONS

The present application is a continuation of U.S. application Ser. No. 18/340,243 filed on Jun. 23, 2023, which is a continuation of U.S. application Ser. No. 17/508,913 filed on Oct. 22, 2021, which claims priority to the Chinese patent application No. 202122291390.0, filed Sep. 22, 2021. All of the above-referenced applications are hereby incorporated by reference in their entirety.

TECHNICAL FIELD

Embodiments of the present disclosure relate to an electrically driven fracturing system.

BACKGROUND

In the exploitation of unconventional oil and gas resources with low permeability, fracturing operations are usually needed to improve production and recovery ratio. A fracturing operation refers to press high-pressure liquid into the formation by a fracturing pump, which causes cracks in the formation, thereby improving the flowing environment of oil and gas underground, and increasing the production of oil and gas wells.

Traditional fracturing operation usually utilizes a diesel engine as the power source, the diesel engine is connected to a gearbox, and the gearbox is connected to a fracturing plunger pump through a transmission shaft and drives the fracturing plunger pump to work. Traditional fracturing apparatus with diesel engine as the power source involves the following shortcomings: (1) Large volume and heavy weight: the diesel engine and the gearbox are large in volume and heavy in weight, restricted in transportation, and poor in power density; (2) Heavy pollution: during the operation of the fracturing apparatus driven by diesel engine, waste gas pollution and noise pollution will occur, for example, the noise may exceed 105 dBA; (3) High cost: the procurement cost of the fracturing apparatus driven by diesel engine is high, the fuel consumption cost per unit power is high when the apparatus runs, and the daily maintenance cost of the engine and the gearbox is also high; (4) The arrangement of the well site occupies a large area. At present, global oil and gas exploitation apparatuses are developed in the direction of "low energy consumption, low noise and low emission", and the traditional fracturing apparatus driven by diesel engine is no longer suitable for fracturing operations.

Electrically driven fracturing apparatus uses external high-voltage electricity as the power source, and drives the fracturing pump to work by an electric motor, which has the advantages of zero tail gas emission, low noise, low energy consumption and good operation stability, and hence is widely used in fracturing operations. However, there are still some problems to be solved in electrically driven fracturing apparatuses and well site operations.

SUMMARY

Embodiments of the present disclosure provide an electrically driven fracturing system. The electrically driven fracturing system includes: one or more frequency converter apparatuses; and a plurality of electrically driven fracturing apparatuses. The electrically driven fracturing apparatus is configured to pressurize and output fluid. One of the one or more frequency converter apparatuses is connected with multiple ones of the plurality of electrically driven fracturing apparatuses, respectively, and the frequency converter apparatus is configured to adjust pressure and flow rate of fluid output by the multiple electrically driven fracturing apparatuses. The number of the frequency converter apparatus can be reduced by connecting one frequency converter apparatus with a plurality of electrically driven fracturing apparatuses, respectively. In this way, on one hand, the area occupied in the well site by the electrically driven fracturing system can be reduced, and on the other hand, the transportation efficiency of the apparatuses can be improved.

In some examples, the frequency converter apparatus includes one rectifier unit and a plurality of inverter units, wherein the rectifier unit includes an input terminal and an output terminal, each of the plurality of inverter units includes an input terminal and an output terminal, the output terminal of the rectifier unit is respectively connected to the input terminals of the plurality of inverter units, the rectifier unit is configured to convert alternating current into direct current, and the inverter units are configured to convert direct current into alternating current.

In some examples, the inverter units are arranged on the electrically driven fracturing apparatuses.

In some examples, each of the electrically driven fracturing apparatuses includes an electric motor, a power interface of the electric motor is connected with the frequency converter apparatus, and the frequency converter apparatus is configured to adjust rotating speed of the electric motor.

In some examples, the inverter units are arranged on the electric motor.

In some examples, each of the electrically driven fracturing apparatuses further includes a fracturing pump connected to an output terminal of the electric motor, and the electric motor is configured to drive the fracturing pump to work.

In some examples, the inverter units are arranged on the frequency converter apparatus.

In some examples, at least one frequency converter apparatus includes one rectifier unit and three inverter units.

In some examples, the frequency converter apparatus further includes a filter unit, the filter unit includes an input terminal and an output terminal, the input terminal of the filter unit is connected to the output terminal of the rectifier unit, and the output terminal of the filter unit is connected to the input terminal of each of the inverter units.

In some examples, the frequency converter apparatus further includes a transformer, the transformer includes an input terminal and an output terminal and is configured to change a voltage at the output terminal of the transformer, and the rectifier unit is connected to the output terminal of the transformer.

In some examples, the frequency converter apparatus further includes a high-voltage load switch configured to be connected to an external alternating current power source; the input terminal of the transformer is connected to the high-voltage load switch.

In some examples, the frequency converter apparatus is one selected from the group consisting of a skid-mounted apparatus, a vehicle-mounted apparatus and a semi-trailer apparatus, and each of the electrically driven fracturing apparatuses is one selected from the group consisting of a skid-mounted apparatus, a vehicle-mounted apparatus and a semi-trailer apparatus.

In some examples, the electrically driven fracturing system further includes at least one selected from the group consisting of a sand mixing apparatus, a liquid mixing and supplying apparatus, and a sand storage and supply apparatus.

In some examples, the electrically driven fracturing system further includes a centralized control system, each of the electrically driven fracturing apparatuses includes a fracturing control system, and the frequency converter apparatus includes a frequency conversion control system, the centralized control system is in communicating connection with the fracturing control system, and the fracturing control system is in communicating connection with the frequency conversion control system.

In some examples, the electrically driven fracturing system further includes a liquid distribution area control system, the centralized control system is in communicating connection with the liquid distribution area control system, and the liquid distribution area control system includes a control system of at least one selected from the group consisting of a sand mixing apparatus, a liquid mixing and supplying apparatus, and a sand storage and supply apparatus.

BRIEF DESCRIPTION OF THE DRAWINGS

In order to more clearly illustrate the technical solutions of the embodiments of the present disclosure, the drawings of the embodiments will be briefly described in the following; it is obvious that the described drawings are only related to some embodiments of the present disclosure and thus are not limitative to the present disclosure.

DETAILED DESCRIPTION

Figure 1:
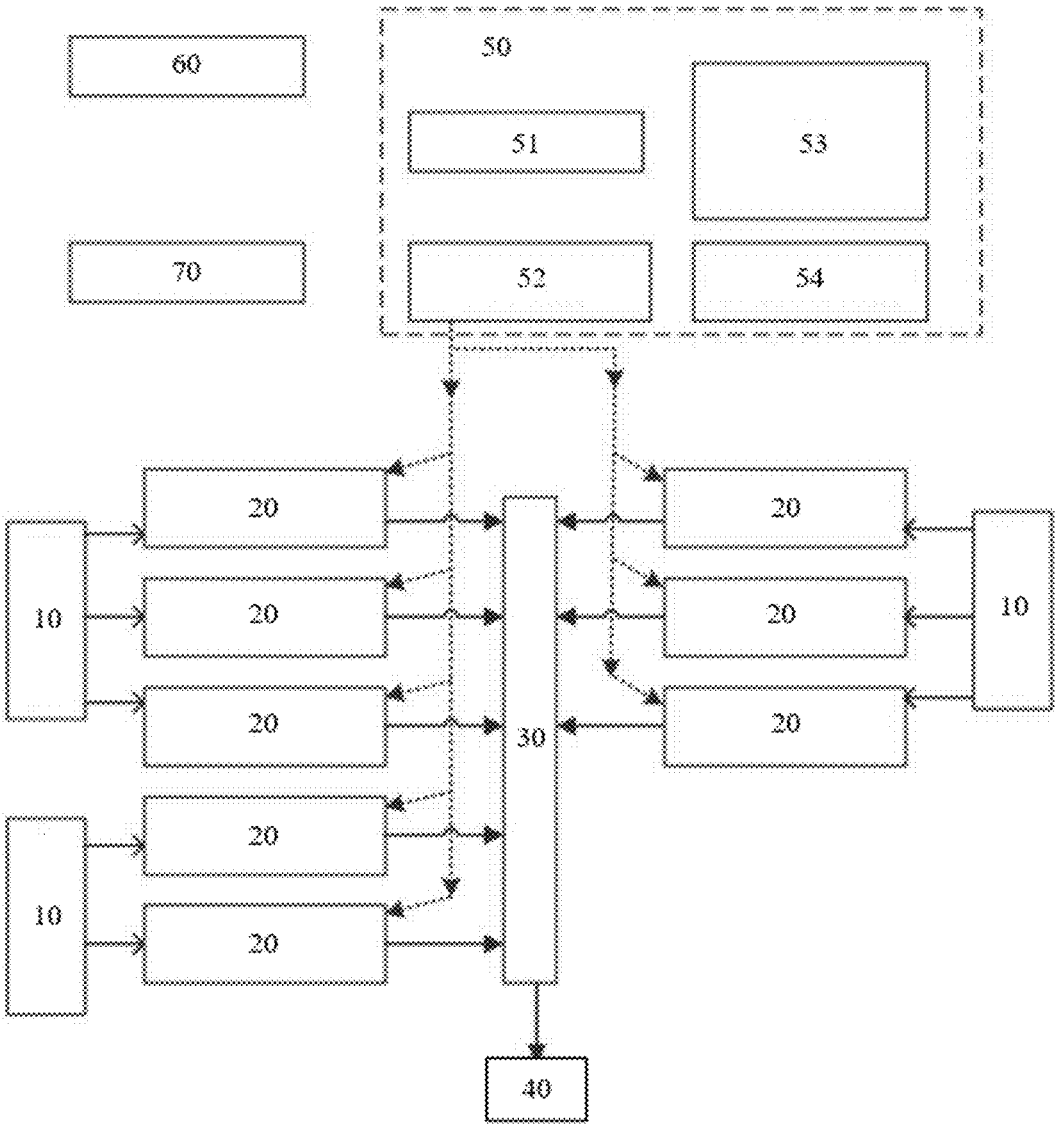
FIG. 1 is a schematic structural diagram of an electrically driven fracturing system according to an embodiment of the present disclosure.

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

The electrically driven fracturing apparatus has the advantages of zero tail gas emission, low noise, low energy consumption, good operation stability and the like, and has been widely used in fracturing operations. However, there are some problems that need to be solved in the well site of electrically driven fracturing operations. For example, the space for the well site of fracturing operations is limited, but it is usually necessary for a plurality of fracturing apparatuses to work at the same time in the process of fracturing operations. Therefore, it needs to optimize the layout of various apparatuses in the well site as much as possible to improve the utilization rate of space. Usually, each fracturing apparatus needs to be equipped with one frequency converter which can be transported and placed in a skid-mounted manner, a semi-trailer manner or a vehicle-mounted manner. If each frequency converter is configured as an independent, skid-mounted, semi-trailer or vehicle-mounted apparatus, it will occupy a large area of the well site and affect the operation layout; furthermore, it also increases the transportation cost.

Embodiments of the present disclosure provide an electrically driven fracturing system. The electrically driven fracturing system includes a first number of frequency converter apparatus(es) and a second number of electrically driven fracturing apparatuses. The electrically driven fracturing apparatus is configured to pressurize and output fluid. The first number is equal to or greater than one, and the second number is greater than one. One frequency converter apparatus is respectively connected with a plurality of electrically driven fracturing apparatuses, and the frequency converter apparatus is configured to adjust the pressure and flow rate of the fluid output by the electrically driven fracturing apparatuses. The number of the frequency converter apparatus can be reduced by connecting one frequency converter apparatus with a plurality of electrically driven fracturing apparatuses, respectively. In this way, on one hand, the area occupied in the well site by the electrically driven fracturing system can be reduced, and on the other hand, the transportation efficiency of the apparatuses can be improved.

Hereinafter, the electrically driven fracturing system provided by the embodiments of the present disclosure will be described in details with reference to the accompanying drawings.

An embodiment of the present disclosure provides an electrically driven fracturing system, and FIG. 1 is a schematic structural diagram of the electrically driven fracturing system. As illustrated in FIG. 1, the electrically driven fracturing system includes a first number of frequency converter apparatus(es) 10 and a second number of electrically driven fracturing apparatuses 20. For example, the first number can be equal or greater than one, that is, one or more frequency converter apparatuses 10 can be provided; the first number can be greater than one, that is, a plurality of electrically driven fracturing apparatuses 20 can be provided. One frequency converter apparatus 10 is connected to a plurality of electrically driven fracturing apparatuses 20, respectively, through cables, and the frequency converter apparatus 10 is configured to adjust the pressure and flow rate of the fluid output by the electrically driven fracturing apparatuses 20.

For example, the electrically driven fracturing apparatus 20 is configured to pressurize low-pressure fracturing fluid and output the pressurized fluid into the down-hole formation. For example, the electrically driven fracturing apparatus 20 can include an electric motor and a fracturing pump, and the electrically driven fracturing apparatus can be in a skid-mounted manner, a vehicle-mounted manner or a semi-trailer manner. The frequency converter apparatus 10 can include one or more frequency converters, and the frequency converter is used for connecting and controlling the electric motor on the electrically driven fracturing apparatus. The frequency converter apparatus can also be in a skid-mounted manner, a vehicle-mounted manner or a semi-trailer manner.

Hereinafter, description will be given with reference to the case where the electrically driven fracturing apparatus and the frequency converter apparatus both are in a skid-mounted manner. As illustrated in FIG. 1, the electrically driven fracturing apparatus 20 can be an electrically driven fracturing skid, and the frequency converter apparatus 10 can be a frequency converter skid. For example, the frequency converter skid is a rectangular skid, and a long side of the frequency converter skid is provided with a frequency converter output interface for connecting with a power interface of the electric motor. When placed on the site, the long side of one frequency converter skid that is provided with the frequency converter output interface is placed adjacent to the sides of a plurality of electrically driven fracturing skids which are provided with electric motors, so as to reduce the cable length between the frequency converter skid and the electrically driven fracturing skids. In this way, a plurality of electrically driven fracturing skids and one frequency converter skid can be combined into a group.

In the electrically driven fracturing system provided by the embodiment of the present disclosure, one frequency converter apparatus is respectively connected with a plurality of electrically driven fracturing apparatuses, so that the number of the frequency converter apparatus can be reduced. In this way, on one hand, the area occupied in the well site by the electrically driven fracturing system can be reduced, and on the other hand, the transportation efficiency of the apparatuses can be improved.

In some examples, as illustrated in FIG. 1, the electrically driven fracturing system includes three frequency converter apparatuses 10 and eight electrically driven fracturing apparatuses 20. The electrically driven fracturing system is divided into three groups, in which two groups each include one frequency converter apparatus 10 and three electrically driven fracturing apparatuses 20, and the remaining group includes one frequency converter apparatus 10 and two electrically driven fracturing apparatuses 20. In this way, when eight electrically driven fracturing apparatuses 20 are in operation, only three frequency converter apparatuses 10 need to be equipped, thus significantly reducing the number of the frequency converter apparatuses, reducing the area occupied in the well site by the electrically driven fracturing system, and reducing the complexity of cable connection on the site. It should be noted that the number of the frequency converter apparatus and the number of the electrically driven fracturing apparatus in FIG. 1 are only an example, and the embodiments of the present disclosure include but are not limited to this.

In some examples, as illustrated in FIG. 1, the electrically driven fracturing system further includes a high-pressure manifold 30. High-pressure fracturing fluid output by each electrically driven fracturing apparatus 20 enters the high-pressure manifold 30, and is connected to the wellhead 40 through the high-pressure manifold 30 for injection into the formation.

In some examples, as illustrated in FIG. 1, the electrically driven fracturing system further includes a fluid distribution area 50. The liquid distribution area 50 can include a liquid mixing and supplying apparatus 51, a sand mixing apparatus 52, a liquid tank 53, a sand storage and supply apparatus 54 and the like. In some cases, the fracturing fluid injected downhole is sand-carrying fluid, and sand particles are suspended in the fracturing fluid by mixing water, sand and chemical additives. For example, clean water and chemical additives can be mixed in the liquid mixing and supplying apparatus 51 to form mixed liquid, and the mixed liquid in the liquid mixing and supplying apparatus 51 and the sand in the sand storage and supply apparatus 54 both enter the sand mixing apparatus 52 to be mixed into sand-carrying fracturing fluid which is required for the fracturing operation. The low-pressure fracturing fluid formed by the sand mixing apparatus 52 is delivered to a liquid inlet of the electrically driven fracturing apparatus 20, and the electrically driven fracturing apparatus 20 pressurizes the low-pressure fracturing fluid and delivers the pressurized liquid to the high-pressure manifold 30.

For example, the power of the liquid mixing and supplying apparatus 51, the sand mixing apparatus 52, and the sand storage and supply apparatus 54 can be provided by the frequency converter apparatus 10 or other power supply apparatus(s) on the site.

In some examples, as illustrated in FIG. 1, the electrically driven fracturing system further includes a power distribution room 60, which can be provided with a transformer. The power distribution room 60 can be used for connecting to external high-voltage alternating current, performing a voltage reduction to the high-voltage alternating current, and distributing the alternating current with voltage reduction to electrical apparatus(es) such as the frequency converter apparatus. For example, the external high-voltage current is 35 kV alternating current, and the power distribution room 60 can reduce the voltage to 10 kV. Of course, the voltage value of the external high-voltage alternating current and the voltage value after voltage reduction herein are given by way of example, and the embodiments of the present disclosure include but are not limited to this. In addition, the frequency converter apparatus can also be directly connected to the external high-voltage alternating current without passing through the power distribution room 60; or, the power distribution room may not be provided with a transformer, but only be used for connecting the electrically driven fracturing system and the high-voltage alternating current of an external power grid or a power generation apparatus, without limited in the embodiments of the present disclosure.

In some examples, as illustrated in FIG. 1, the electrically driven fracturing system further includes a centralized control system 70. The centralized control system 70 is in communicating connection with each apparatus in the system to control the operation of each apparatus. For example, the centralized control system 70 can be connected to various apparatuses in the system through a wired network or a wireless network. The centralized control system 70 will be further described later.

Figure 2:
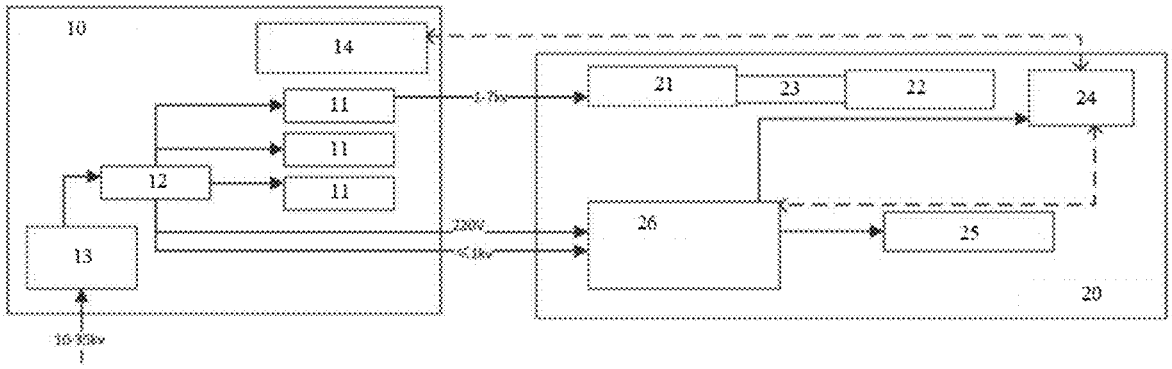
FIG. 2 is another schematic structural diagram of an electrically driven fracturing system according to an embodiment of the present disclosure.
Figure 3:
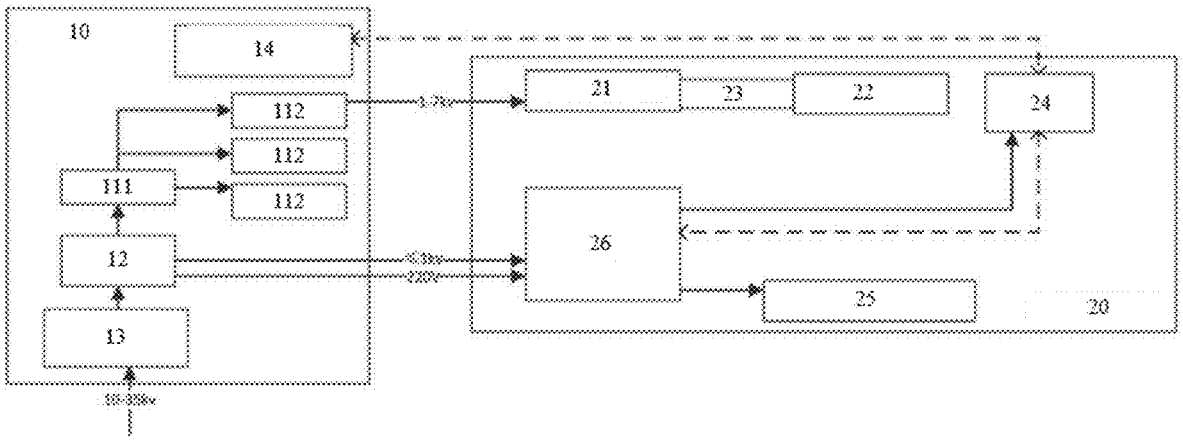
FIG. 3 is another schematic structural diagram of an electrically driven fracturing system according to an embodiment of the present disclosure.

FIG. 2 is another schematic structural diagram of the electrically driven fracturing system, which illustrates the connection relationship between the frequency converter apparatus and the electrically driven fracturing apparatus;

FIG. 3 is another schematic structural diagram of the electrically driven fracturing system, which illustrates the connection relationship between the frequency converter apparatus and the electrically driven fracturing apparatus.

In some examples, as illustrated in FIG. 2, the frequency converter apparatus 10 includes a transformer 12 and a plurality of frequency converters 11. The transformer 12 includes an input terminal and a plurality of output terminals, and the transformer 12 is configured to change the voltages at the output terminals. The frequency converter 11 includes an input terminal and an output terminal, and the input terminal of the frequency converter 11 is connected to one of the output terminals of the transformer 12. The electrically driven fracturing apparatus 20 includes an electric motor 21, a shaft coupling 23 and a fracturing pump 22. The fracturing pump 22 can be, for example, a plunger pump. The shaft coupling 23 can be a transmission shaft or a shaft coupling with clutching function. The output terminal of the frequency converter 11 is connected to the power interface of the electric motor 21. The output terminal of the electric motor 21 is connected to the fracturing pump 22 through the shaft coupling 23 and drives the fracturing pump 22 to work. Each frequency converter 11 is connected with one corresponding electric motor 21. The frequency converter 11 is configured to adjust the frequency of the current, so as to adjust the rotating speed of the electric motor 21, thereby adjusting the flow rate and pressure output by the fracturing pump.

For example, as illustrated in FIG. 2, the frequency converter apparatus 10 includes a high-voltage load switch 13, and the input terminal of the transformer 12 is connected to the high-voltage load switch 13. The external high-voltage alternating current enters the transformer 12 through the high-voltage load switch 13, and is output to the plurality of frequency converters 11, respectively, after a voltage reduction by the transformer 12. The plurality of output terminals of the transformer 12 can output different voltages, respectively, and the output terminals of the transformer 12 can also supply power for other electrical apparatus(es).

In some examples, as illustrated in FIG. 2, the electrically driven fracturing apparatus 20 can further include a fracturing control system 24, a power distribution system 26 and an auxiliary electric motor 25. The power distribution system 26 is connected to one of the output terminals of the transformer 12, and the auxiliary electric motor 25 is connected to the power distribution system 26. For example, the auxiliary electric motor 25 is used for driving some auxiliary power consumption units of the electrically driving fracturing apparatus 20 to work, and the auxiliary power consumption units include, for example, a motor of lubrication system, a motor of cooling system, a control system and the like. The fracturing control system 24 is used for adjusting operating parameters of the fracturing pump according to conditions on the site. The frequency converter apparatus 10 can further include a frequency conversion control system 14 for controlling the operating parameters of the frequency converter 11.

For example, as illustrated in FIG. 2, 10 kV-35 kV alternating current from the external power grid or power generation apparatus enters the high-voltage load switch 13 and then enters the transformer 12, and the transformer 12 can output a variety of different voltages. For example, after a voltage is output to the frequency converter 11, a voltage output from the frequency converter 11 to the electric motor 21 can be 1 kV-7 kV. The voltage output to the power distribution system 26 can be 220V, or less than or equal to 1 kV. Of course, the voltage value of each apparatus is given by way of example, without constituting any limitation to the embodiments of the present disclosure.

In some examples, as illustrated in FIG. 3, the frequency converter apparatus 10 includes one rectifier unit 111 and a plurality of inverter units 112. The rectifier unit 111 includes an input terminal and an output terminal, and the inverter unit 112 includes an input terminal and an output terminal. The output terminal of the rectifier unit 111 is connected to the input terminal of each of the plurality of inverter units 112, respectively. The rectifier unit 111 is configured to convert alternating current into direct current, and the inverter unit 112 is configured to convert direct current into alternating current. The rectifier unit 111 and the inverter unit 112 constitute the frequency converter 11 in FIG. 2.

For example, as illustrated in FIG. 3, the rectifier unit 111 and the inverter unit 112 can both be provided on the frequency converter apparatus 10.

For example, the rectifier unit 111 and the inverter unit 112 can also be arranged separately, that is, the rectifier unit 111 is arranged on the frequency converter apparatus 10, while the inverter unit 112 is arranged on the electrically driven fracturing apparatus 20. For example, the inverter unit 112 can be arranged on the electric motor 21 of the electrically driven fracturing apparatus 20; and the inverter unit 112 and the electric motor 21 can share a heat dissipation device.

By arranging the inverter unit on the electrically driven fracturing apparatus, it can reduce the weight of the frequency converter apparatus and save the space of the frequency converter apparatus, which is beneficial to optimize the layout of the devices such as transformers and rectifiers in the frequency converter apparatus, or is beneficial to arrange other device(s). The inverter unit is arranged on the electrically driven fracturing apparatus, so that it has no need to perform the wired connection of the inverter unit and the electric motor before the fracturing operation every time, and the operation complexity is reduced.

For example, one frequency converter apparatus 10 can include one rectifier unit 111 and three inverter units 112 so as to drive three electrically driven fracturing apparatuses 20. Of course, one frequency converter apparatus can also include other numbers of inverter units, without limited in the embodiments of the present disclosure.

For example, the frequency converter apparatus 10 further includes a filter unit, which can be arranged between the rectifier unit 111 and the inverter unit 112, and is used for filtering out voltage pulsation in the rectifier unit and stabling the voltage entering the inverter unit. For example, the filter unit includes an input terminal and an output terminal, the input terminal of the filter unit is connected to the output terminal of the rectifier unit 111, and the output terminal of the filter unit is connected to the input terminal of the inverter unit 112.

In order to meet the requirements of centralized control of apparatuses, the electrically driven fracturing system is provided with an instrument apparatus, the instrument apparatus can directly or indirectly integrate the control systems of a plurality of apparatuses of the electrically driven fracturing system together, so as to realize a centralized control. Hereinafter, the control systems of the electrically driven fracturing system will be further described with reference to the accompanying drawings.

Figure 4:
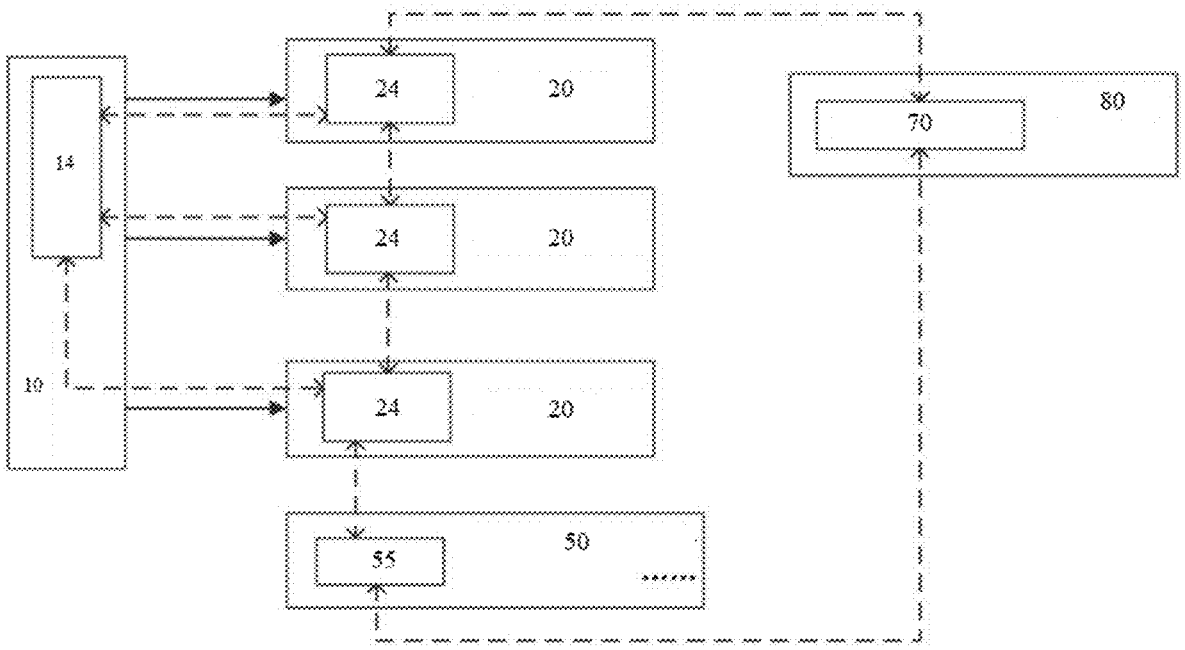
FIG. 4 is a schematic diagram of a control system of an electrically driven fracturing system according to an embodiment of the present disclosure.

FIG. 4 is a schematic diagram of the control system in the electrically driven fracturing system. As illustrated in FIG. 4, the electrically driven fracturing system is provided with an instrument apparatus 80, in which a centralized control system 70 and instrument display panels or control panels of various apparatuses in the electrically driven fracturing system are integrated.

Many apparatuses in the electrically driven fracturing system are equipped with their own control systems. For example, as illustrated in FIG. 4, the frequency converter apparatus 10 includes a frequency conversion control system 14, the frequency conversion control system 14 can control the operating parameters of the frequency converter 11; the electrically driven fracturing apparatus 20 includes a fracturing control system 24, the fracturing control system 24 can adjust the operating parameters of the fracturing pump 22. The electrically driven fracturing system further includes other apparatuses of the fracturing well site and corresponding control systems, which will not be described in details in the embodiments of the present disclosure.

For example, as illustrated in FIG. 4, the centralized control system 70 is in communicating connection with the fracturing control system 24; and the fracturing control system 24 is in communicating connection with the frequency conversion control system 14. In this way, through the communicating connection between the fracturing control system 24 and the frequency conversion control system 14, the frequency converter apparatus 10 can be controlled by the fracturing control system 24, so that the frequency of the alternating current output by the frequency converter can be controlled, and the rotating speed of the electric motor on the electrically driven fracturing apparatus 20 can be adjusted. Through the communicating connection between the centralized control system 70 and the fracturing control system 24, the centralized control system 70 can be in indirectly communicating connection with the frequency conversion control system 14, so that the electrically driven fracturing apparatus 20 and the frequency converter apparatus 10 can be controlled by the centralized control system 70, that is, a remote centralized control of the electrically driven fracturing operation can be realized.

For example, the centralized control system 70 can be in communicating connection with the fracturing control system 24 and control systems of other apparatuses in the electrically driven fracturing system through a wired network or a wireless network.

For example, the remote centralized control of the electrically driven fracturing operation includes: start-up and shut-down of electric motor, rotating speed adjustment of electric motor, emergency stop of electric motor, reset of frequency converter, monitoring of key parameters (voltage, current, torque, frequency and temperature), and the like. The electrically driven fracturing system can include a plurality of fracturing control systems 24 and a plurality of frequency conversion control systems 14, all of the plurality of fracturing control systems 24 and the plurality of frequency conversion control systems 14 can be connected to the centralized control system 70. All the electrically driven fracturing apparatuses and frequency converter apparatuses can be controlled by the centralized control system 70.

For example, as illustrated in FIG. 4, the plurality of fracturing control systems 24 can be connected to the centralized control system 70 through a loop network structure, and the frequency conversion control system 14 is indirectly connected to the centralized control system 70 through the fracturing control system 24. In this way, the centralized control of the electrically driven fracturing operation can be realized conveniently and efficiently, without the need of directly connecting the frequency conversion control system to the centralized control system 70 or instrument apparatus 80, thereby simplifying the control systems of the whole electrically driven fracturing system.

For example, as illustrated in FIG. 4, the liquid distribution area 50 is provided with a liquid distribution area control system 55, and the liquid distribution area control system 55 is used for controlling at least one selected from the group consisting of a sand mixing apparatus 52, a liquid mixing and supplying apparatus 51 and a sand storage and supply apparatus 54. As illustrated in FIG. 4, the liquid distribution area control system 55 can also be connected to the centralized control system 70, so as to realize a remote centralized control of the liquid distribution area control system 55.

For example, other apparatus(s) of the electrically driven fracturing system and corresponding control system(s) can also be connected to the centralized control system, so as to realize the remote centralized control of the whole electrically driven fracturing system by the centralized control system and to improve the control efficiency.

The following statements should be noted:

(1) The accompanying drawings involve only the structure(s) in connection with the embodiment(s) of the present disclosure, and other structure(s) can be referred to common design(s).

(2) In case of no conflict, features in one embodiment or in different embodiments can be combined.

What have been described above are only specific implementations of the present disclosure, the protection scope of the present disclosure is not limited thereto. Any changes or substitutions easily occur to those skilled in the art within the technical scope of the present disclosure should be covered in the protection scope of the present disclosure. Therefore, the protection scope of the present disclosure should be based on the protection scope of the claims.

What is claimed is:

1. An electrically-driven fracturing system, comprising:

a plurality of frequency converter apparatuses;

a plurality of electrically-driven fracturing apparatuses and configured to output pressurized fracturing fluid; and a centralized control system, wherein:

each of the plurality of frequency converter apparatuses is correspondingly connected to at least one electrically-driven fracturing apparatus of the plurality of electrically-driven fracturing apparatuses, and comprises a frequency conversion control system to form a plurality of frequency conversion control systems, each of the plurality of electrically-driven fracturing apparatuses comprises an electric motor, and a fracturing control system to form a plurality of fracturing control systems, the centralized control system is in communicating connection with the fracturing control systems such that the centralized control system and the fracturing control systems form a loop structure in which the fracturing control systems are connected in series with each other and with the centralized control system, the centralized control system is in communicative connection with the frequency conversion control systems via one or more of the fracturing control systems, and each of the plurality of frequency converter apparatuses is configured to adjust a rotating speed of the electric motor by adjusting a frequency of the electric motor to adjust pressure and flow rate of the pressurized fracturing fluid.

2. The electrically-driven fracturing system of claim 1, wherein each of the plurality of frequency converter apparatuses comprises a rectifier and one or more inverters, wherein:

the rectifier is connected to the one or more inverters, the rectifier comprises an input terminal and an output terminal, each of the one or more inverters comprises an input terminal and an output terminal, and the output terminal of the rectifier is connected to the input terminals of the one or more inverters.

3. The electrically-driven fracturing system of claim 2, wherein the one or more inverters are arranged on the electrically-driven fracturing apparatuses.

4. The electrically-driven fracturing system of claim 3, wherein a power interface of the electric motor is connected to the plurality of frequency converter apparatuses.

5. The electrically-driven fracturing system of claim 4, wherein the one or more inverters are arranged on the electric motor.

6. The electrically-driven fracturing system of claim 4, wherein each of the electrically-driven fracturing apparatuses further comprises a fracturing pump connected to an output terminal of the electric motor through a shaft coupling, and the electric motor drives the fracturing pump.

7. The electrically-driven fracturing system of claim 2, wherein the one or more inverters are arranged on the plurality of frequency converter apparatuses.

8. The electrically-driven fracturing system of claim 2, wherein each of the plurality of frequency converter apparatuses further comprises a filter, the filter comprises an input terminal and an output terminal, the input terminal of the filter is connected to the output terminal of the rectifier, and the output terminal of the filter is connected to the input terminal of each of the one or more inverters.

9. The electrically-driven fracturing system of claim 2, wherein each of the plurality of frequency converter apparatuses further comprises a transformer, the transformer comprises an input terminal and an output terminal, and the rectifier is connected to the output terminal of the transformer.

10. The electrically-driven fracturing system of claim 9, wherein each of the plurality of frequency converter apparatuses further comprises a load switch connected to an external alternating current power source; and the input terminal of the transformer is connected to the load switch.

11. The electrically-driven fracturing system of claim 2, wherein:

each of the plurality of electrically-driven fracturing apparatuses comprises an auxiliary electric motor and a power distribution system connected to the auxiliary electric motor and the fracturing control system; and each of the plurality of frequency converter apparatuses further comprises a transformer correspondingly connected to the power distribution system.

12. The electrically-driven fracturing system of claim 11, wherein:

each of the plurality of frequency converter apparatuses comprises a transformer and one or more frequency converters; and the transformer is connected to the one or more frequency converters.

13. The electrically-driven fracturing system of claim 12, wherein:

the transformer outputs a voltage of no more than 1 kV to the power distribution system; and at least one of the one or more frequency converters outputs a voltage of 1 kV to 10 kV to the transformer.

14. The electrically-driven fracturing system of claim 1, wherein each of the plurality of frequency converter apparatuses is mounted on a skid, a vehicle, or a semi-trailer, and each of the plurality of electrically-driven fracturing apparatuses is mounted on a skid, a vehicle, or a semi-trailer.

15. The electrically-driven fracturing system of claim 1, further comprising at least one selected from the group consisting of a sand mixing apparatus, a liquid mixing and supplying apparatus, and a sand storage and supply apparatus.

16. The electrically-driven fracturing system of claim 1, further comprising a liquid distribution area control system, wherein the centralized control system is in communicative connection with the liquid distribution area control system, and the liquid distribution area control system comprises a control system of at least one selected from the group consisting of a sand mixing apparatus, a liquid mixing and supplying apparatus, and a sand storage and supply apparatus.

17. The electrically-driven fracturing system of claim 1, wherein:

each of the plurality of electrically-driven fracturing apparatuses comprises an auxiliary electric motor and a power distribution system connected to the auxiliary electric motor and the fracturing control system; and each of the plurality of frequency converter apparatuses further comprises a transformer correspondingly connected to the power distribution system.

18. The electrically-driven fracturing system of claim 17, wherein:

each of the plurality of frequency converter apparatuses comprises a transformer and one or more frequency converters; and the transformer is connected to the one or more frequency converters.

19. The electrically-driven fracturing system of claim 18, wherein:

the transformer outputs a voltage of no more than 1 kV to the power distribution system; and at least one of the one or more frequency converters outputs a voltage of 1 kV to 10 kV to the transformer.

20. The electrically-driven fracturing system of claim 1, wherein:

each of the plurality of frequency converter apparatuses comprises a load switch that receives a voltage input of 10 kV to 35 kV.

* * * * *